US009419384B1

(12) United States Patent
Nguyen

(10) Patent No.: US 9,419,384 B1
(45) Date of Patent: Aug. 16, 2016

(54) CONNECTION SYSTEM FOR AN ELECTRICAL CABLE

(71) Applicant: ITT MANUFACTURING ENTERPRISES, LLC, Wilmington, DE (US)

(72) Inventor: Le Huu Nguyen, Irvine, CA (US)

(73) Assignee: ITT MANUFACTURING ENTERPRISES, LLC, Wilmington, DE (US)

( * ) Notice: Subject to any disclaimer, the term of this patent is extended or adjusted under 35 U.S.C. 154(b) by 0 days.

(21) Appl. No.: 14/615,789

(22) Filed: Feb. 6, 2015

(51) Int. Cl.

| | |
|---|---|
| ***H01R 13/6593*** | (2011.01) |
| ***H01R 24/40*** | (2011.01) |
| ***H01R 13/6592*** | (2011.01) |
| ***H01R 4/18*** | (2006.01) |
| ***H01R 13/52*** | (2006.01) |

(52) U.S. Cl.
CPC ..... *H01R 13/6592* (2013.01); *H01R 4/18* (2013.01); *H01R 13/5205* (2013.01)

(58) Field of Classification Search
CPC .. H01R 2103/00; H01R 13/658; H01R 4/646; H01R 24/40; H01R 9/05; H01R 13/6593; H01R 13/6592
See application file for complete search history.

(56) References Cited

U.S. PATENT DOCUMENTS

| | | | | |
|---|---|---|---|---|
| 3,275,737 A | | 9/1966 | Caller | |
| 3,551,882 A | * | 12/1970 | O'Keefe | H01R 24/40 174/75 C |
| 3,936,132 A | | 2/1976 | Hutter | |
| 3,944,317 A | | 3/1976 | Oberdiear | |
| 4,307,926 A | * | 12/1981 | Smith | H01R 24/562 439/580 |
| 4,398,783 A | | 8/1983 | Kelly | |
| 4,464,540 A | | 8/1984 | Reeder | |
| 4,531,805 A | | 7/1985 | Werth | |
| 4,693,323 A | | 9/1987 | Owensby | |
| 4,808,128 A | | 2/1989 | Werth | |
| 4,813,887 A | * | 3/1989 | Capp | H01R 24/562 439/580 |
| 4,858,310 A | | 8/1989 | Sanders | |
| 5,046,967 A | | 9/1991 | Majernik et al. | |
| 5,052,947 A | | 10/1991 | Brodie et al. | |
| 5,547,395 A | | 8/1996 | Delamotte | |
| 6,705,894 B1 | * | 3/2004 | Comerci | H01R 13/506 439/607.47 |
| 6,809,265 B1 | | 10/2004 | Gladd et al. | |
| 6,811,441 B2 | * | 11/2004 | Simpson | H01R 13/5845 439/457 |
| 7,901,239 B2 | * | 3/2011 | Weber | H01R 13/7197 439/455 |
| 7,977,583 B2 | | 7/2011 | Yaghmai et al. | |

(Continued)

FOREIGN PATENT DOCUMENTS

| | | |
|---|---|---|
| EP | 2234215 A1 | 9/2010 |
| GB | 1016868 | 1/1966 |
| JP | H07-014645 | 1/1995 |

OTHER PUBLICATIONS

Glenair, "The Band-It® Clamping System EMI Shield Termination Instructions," 2010, 1 page.

(Continued)

*Primary Examiner* — Gary Paumen
(74) *Attorney, Agent, or Firm* — Knobbe, Martens, Olson & Bear, LLP

(57) ABSTRACT

A connection system for a cable includes a shielded cable that is inserted into a backshell. Among other elements, the shielded cable might include a ferrule that is crimped between shields near an end of the cable. In addition, the backshell includes a channel that clamps around the ferrule, as well as various solder wells.

18 Claims, 6 Drawing Sheets

(56) References Cited

U.S. PATENT DOCUMENTS 8,202,122 B2 * 6/2012 Wu ..... H01R 13/6581
439/352

2012/0276778 A1 * 11/2012 Figie ..... H01R 13/502
439/607.47

OTHER PUBLICATIONS

Glenair, "Rectangular Connector Backshells," 2011, 284 pages.

* cited by examiner

CONNECTION SYSTEM FOR AN ELECTRICAL CABLE

BACKGROUND

Electrical cables are often encased in one or more types of insulators, some of which are referred to as "shields." For example, a cable might include an inner shield and an outer shield. Shields can serve various functions, such as reducing interference, noise, and leakage. Shields might be further encased by another layer of protection, which is sometimes referred to as a "jacket." A backshell is often attached to an end of the cable as part of a terminus for the shields and jacket.

One type of shield is a "braided shield," which includes a tubular body having a wall that is constructed of woven filaments. The filaments might include various materials, such as copper or aluminum. Braided shields provide a certain amount of optical coverage for cables. However, when a portion of the braided shield enters a backshell, the portion often begins to flare which creates gaps between the woven filaments. These gaps can reduce the amount of optical coverage and causes leakage.

SUMMARY

An embodiment of the present invention is directed to a connection system for a cable. The connection system includes a shielded cable that is inserted into a backshell. Among other elements, the shielded cable might include a ferrule that is crimped between shields near an end of the cable. In addition, the backshell includes a channel that clamps around the ferrule, as well as various solder wells.

Embodiments of the invention are defined by the claims below, not this summary. A high-level overview of various aspects of the invention is provided here to introduce a selection of concepts that are further described in the detailed-description section below. This summary is not intended to identify key features or essential features of the claimed subject matter, nor is it intended to be used as an aid in isolation to determine the scope of the claimed subject matter.

BRIEF DESCRIPTION OF THE DRAWINGS

Illustrative embodiments of the present invention are described in detail below with reference to the attached drawing figures, which are incorporated herein by reference, wherein.

DETAILED DESCRIPTION

The subject matter of embodiments of the present invention is described with specificity herein to meet statutory requirements. But the description itself is not intended to necessarily limit the scope of claims. Rather, the claimed subject matter might be embodied in other ways to include different elements or combinations of elements similar to the ones described in this document, in conjunction with other present or future technologies. Terms should not be interpreted as implying any particular order among or between various steps herein disclosed unless and except when the order of individual steps is explicitly described.

Generally, an embodiment of the present invention is directed to a connection system for a shielded cable. Among other elements, the shielded cable includes an inner shield and an outer braided shield. In addition, the shielded cable is terminated at a backshell. Absent the present invention, the outer braided shield might flare at the backshell, causing leaks. To reduce leakage, an aspect of the present invention includes a ferrule, which is positioned between an inner shield and the outer braided shield. In addition, an aspect includes a backshell configured with a cylindrical channel that receives a portion of the shielded cable and clamps around the braided shield, the ferrule, and the inner shield. The backshell also includes solder and epoxy wells for additional sealing.

Figure 1:
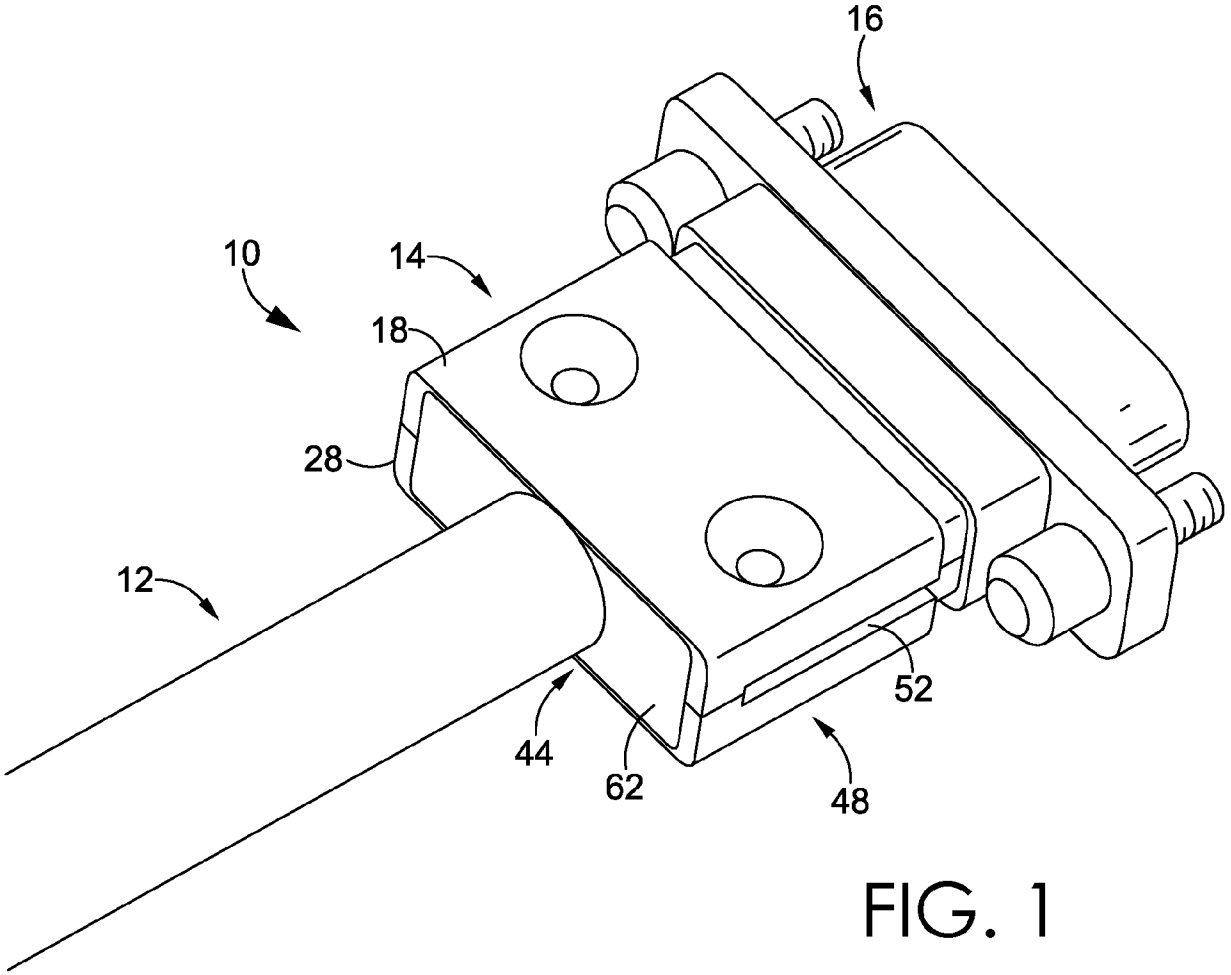
FIG. 1 depicts a cable terminated by a backshell and connector in accordance with an embodiment of the present invention.

Referring to FIG. 1, a connection system 10 is depicted in which a shielded cable 12 is terminated by a backshell 14 and a connector 16. Generally, the shielded cable 12 is inserted into a rear portion of the backshell 14, and the backshell is coupled to the connector 16 for connecting to other electrical components (e.g., cables, devices, etc.).

Figure 2:
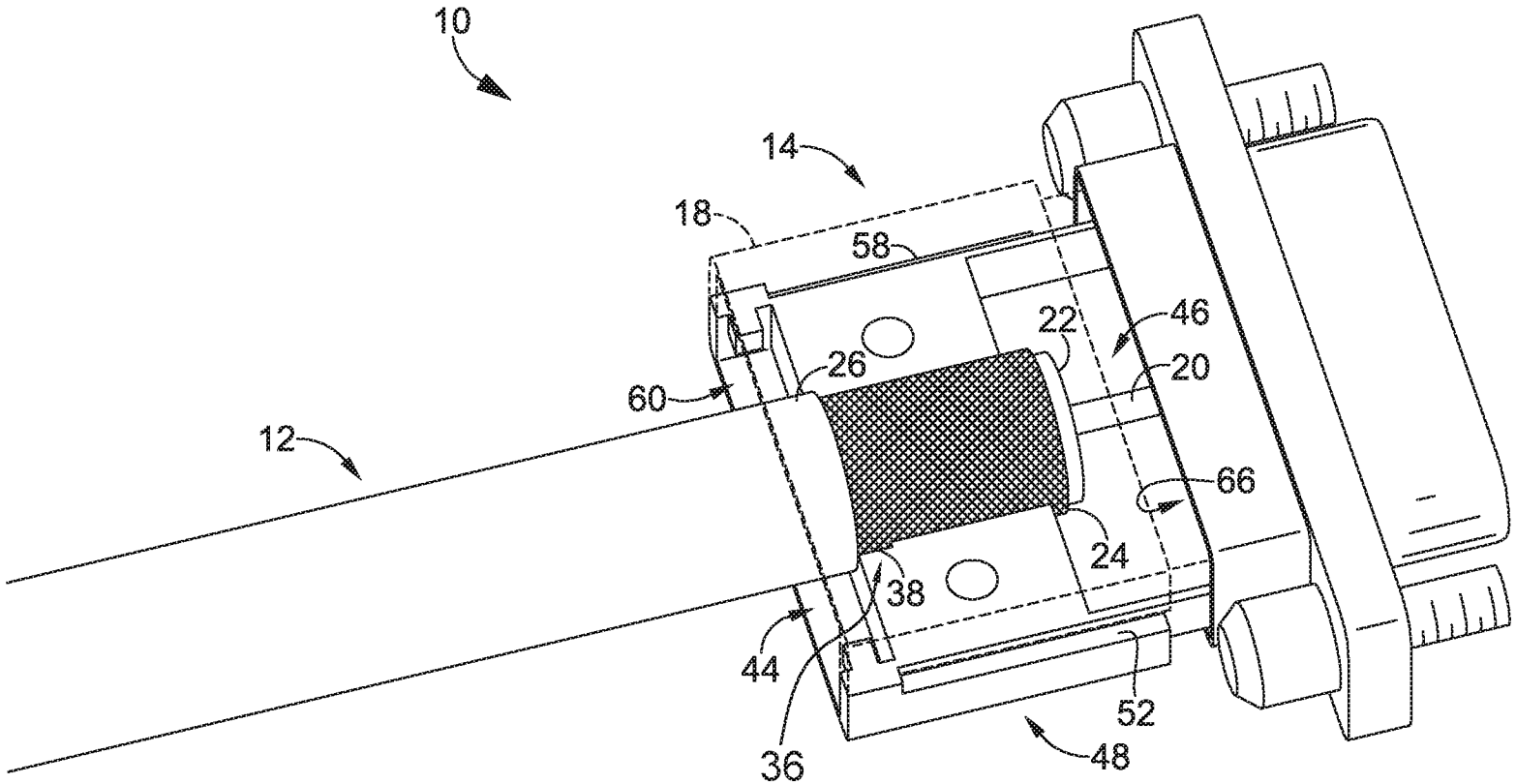
FIG. 2 depicts the cable and backshell of FIG. 1 with part of the backshell ghosted in order to illustrate some internal configurations in accordance with an embodiment of the present invention.

Referring to FIG. 2, the connection system 10 is depicted, and a top portion 18 of the backshell 14 is ghosted in order to illustrate some components that are obstructed from view in FIG. 1. For example, in FIG. 2 the shielded cable 12 includes a cable 20, which is encased by an inner shield 22 (e.g., foil shield). In addition, the inner shield 22 is encased by a braided outer shield 24, which is further encased by a jacket 26.

Figure 3:
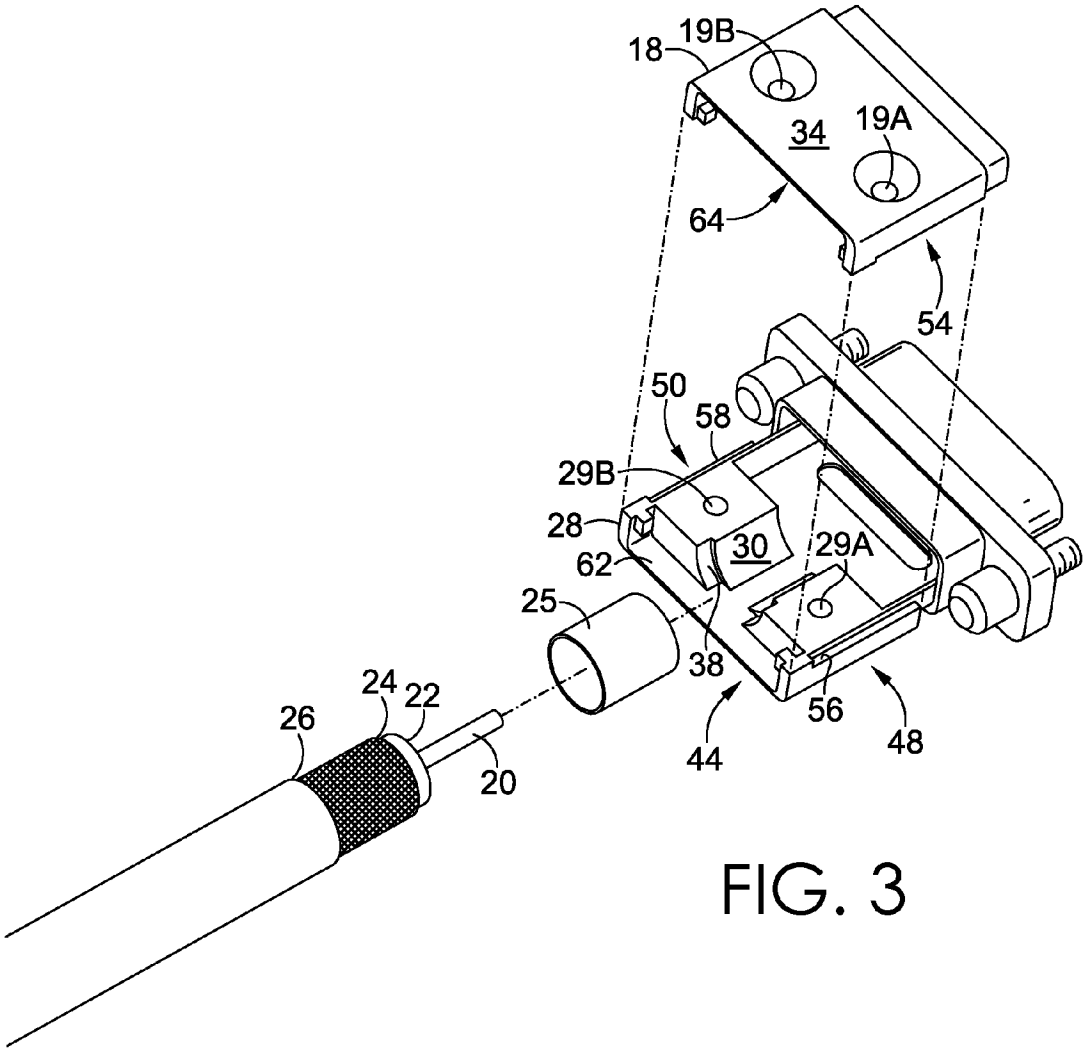
FIG. 3 depicts an exploded view of some elements of the cable and backshell of FIG. 1 in accordance with an embodiment of the present invention.

In a further embodiment, the cable assembly includes a ferrule 25 positioned between the inner shield 22 and the outer shield 24. The ferrule 25 might be at least partially hidden underneath the outer shield 24, such that the ferrule 25 is not viewable in FIG. 2. However, FIG. 3 depicts the ferrule 25 that would be slid between the inner shield 22 and the outer shield 24 prior to attaching the backshell 14 to the cable.

Figure 4:
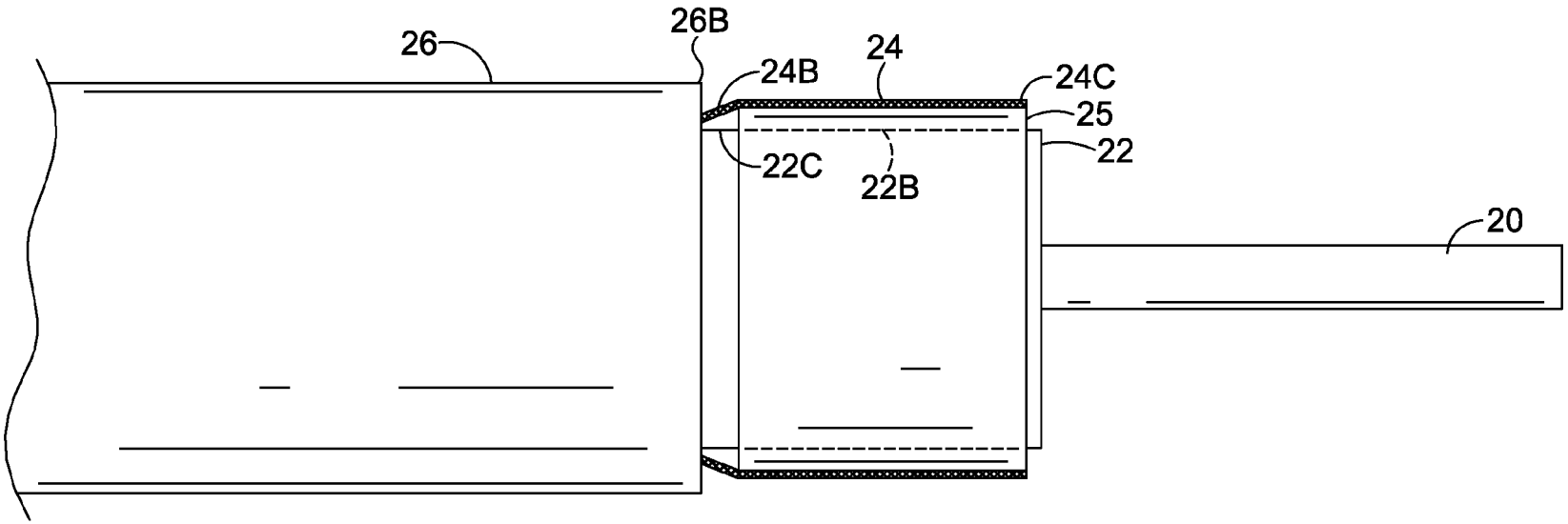
FIG. 4 depicts a partial cross section of a cable in accordance with an embodiment of the present invention.

For illustrative purposes, a partial cross section of the cable 12 is depicted in FIG. 4, which illustrates the layering of the components in the cable system. For instance, FIG. 4 illustrates a set of one or more wires 20 and the inner shield 22 that at least partially encases the set of one or more wires 20. The ferrule 25 is positioned between the inner shield 22 and the outer shield 24 and at least partially circumscribes a segment 22B of the inner shield 22. Accordingly, the ferrule 25 provides a full 360 degrees circumferential connection with low-impedance to the ground.

In a further aspect, the inner shield 22 also includes a non-circumscribed portion 22C that is not circumscribed by the ferrule 25. In FIG. 4, the outer shield 24 (e.g., braided shield) at least partially encases the ferrule 25, and the outer shield 24 includes a portion 24B that does not encase the ferrule 25 and that is layered directly adjacent to the non-circumscribed portion 22C of the inner shield. The cable jacket 26 encases the outer shield 24, which includes a terminus 24C that extends beyond a cable-jacket terminus 26B of the cable jacket 26. That is, the outer shield 24 includes a non-encased portion, which at least partially overlaps with the portion 24B that is layered directly adjacent to the inner shield.

Referring back to FIG. 3, the backshell 14 includes the top portion 18 and the bottom portion 28 that mate with one another. For instance, the top portion 18 includes fastener holes 19A and 19B that are aligned with fastener holes 29A and 29B of the bottom portion 28. Fasteners (not shown) are secured in the aligned holes to couple the top portion 18 to the bottom portion 28.

In a further aspect, a cylindrical channel is formed between the top portion 18 and the bottom portion 28 when the two portions are coupled to one another, and the cylindrical channel receives the cable 12. For example, referring to FIG. 2 a portion of the cable that is received between the top portion 18 and the bottom portion 28 is positioned in the cylindrical channel. FIG. 3 more clearly shows that the bottom portion 28 includes a concave interior surface 30 that forms part of the wall of the cylindrical channel. The top portion 18 includes another concave interior surface 32 that generally opposes the bottom-portion concave interior surface 30 and that is obstructed from view in FIG. 3 (beneath surface 34).

Figure 6:
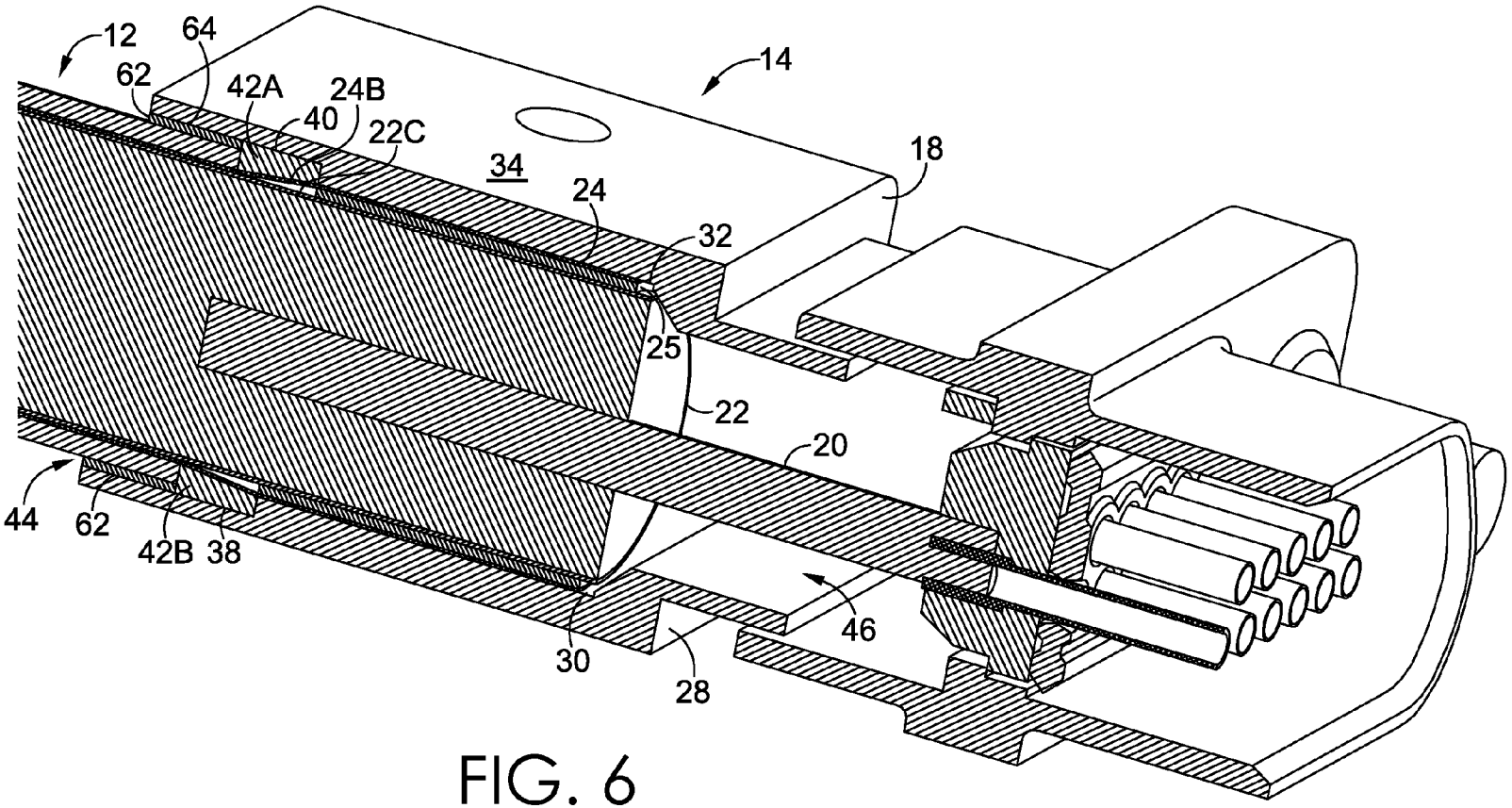
FIG. 6 depicts another cross-sectional view of a cable terminated by a backshell and connector in accordance with an embodiment of the present invention.

The concave interior surface 32 of the top portion 18 is depicted in FIG. 6, which shows a cross-sectional view of the backshell 14 attached to a cable 12. FIG. 6 also illustrates that the inner shield 22, the ferrule 25, and the outer shield 24 are crimped in the cylindrical channel and between the top-portion concave interior surface 32 and the bottom-portion concave interior surface 30 when the top portion 18 and the bottom portion 28 are coupled to one another. As such, the top portion 18 and the bottom portion 28 each includes respective concave interior surfaces 32 and 30 that form walls of the cylindrical channel when the portions 18 and 28 mate with one another, and the non-encased portion of the outer shield 24 (i.e., not encased by the jacket 26) is housed in the cylindrical channel.

In another aspect of the present invention, an internal groove 36 is formed between the top portion 18 and the bottom portion 28 when the two portions are coupled to one another, and the internal groove 36 is axially adjacent to the cylindrical channel. For example, referring to FIG. 2 the internal groove 36 circumscribes a non-encased portion of the outer shield 24. FIG. 3 more clearly shows that the bottom portion 28 includes a concave internal groove 38 that forms part of the wall of the internal groove 36. The top portion 18 includes another internal groove 40 that generally opposes the bottom-portion internal groove 38 and that is obstructed from view in FIG. 3 (beneath surface 34 and depicted in FIG. 6). The concave internal grooves 38 and 40 align when the backshell portions 18 and 28 are mated to form the circumscribing internal groove 36 next to the cylindrical channel.

The internal groove 40 of the top portion 18 is depicted in FIG. 6, which also illustrates that the inner shield 22C (non-circumscribed by the ferrule 25) and the outer shield 24B are circumscribed by the internal groove 36 (formed by grooves 38 and 40). As such, the cylindrical internal groove circumscribes the portion 24B of the outer shield layered directly adjacent to the inner shield 24B, when the cable is housed in the backshell. The cylindrical internal groove 36 provides a solder well for receiving a solder material 42A and 42B (FIG. 6), which provides a seal around the portion 24B of the braided shield. Once the cylindrical internal groove 36 is filled with solder material, the inner and outer shields are connected 360 degrees circumferentially to maintain high optical coverage of the braided outer shield 24.

Referring to the various figures, the top and bottom backshell members 18 and 28 mate to form the backshell 14, which includes a cable-insertion end 44, a terminus end 46, a first side 48, and a second side 50. In addition, the backshell 14 includes the top surface 34 and a bottom surface (obstructed from view), which opposes the top surface 34. Respective terms, such as top, bottom, left, right, front, back, rear, and the like, might be used in this description with reference to the drawings to describe certain parts or regions of the connection system 10. But these terms are merely descriptive to distinguish one part from another part in the context of the subject figure and are not limiting.

In another embodiment, the top portion 18 of the backshell and the bottom portion 28 of the backshell each includes respective channels that mate with one another to form epoxy or solder wells (e.g., 52 and 60). For example, the first side 48 of the backshell 14 includes a first solder well 52 (FIGS. 1 and 2) that is fillable with solder material when the portions 18 and 28 are coupled. The first solder well 52 is formed by a first channel 54 (FIG. 3) positioned along the first-side edge of the top portion 18 and by a second channel 56 positioned along the first-side edge of the bottom portion 28.

The second side 50 of the backshell 14 includes a second solder well that essentially mirrors the first solder well 52 (except for being positioned on the opposing side) and that is also fillable with solder material when the portions 18 and 28 are coupled. The second solder well is formed by a third channel (obstructed from view) positioned along the second-side edge of the top portion 18 and by a fourth channel 58 positioned along the second-side edge of the bottom portion 28. The first solder well 52 and second solder well serve various functions, such as providing a high-frequency seal and blocking EMI/RF leaks.

In another embodiment, the connection system 10 includes a rear well 60 for receiving an epoxy material 62 (FIG. 1), which helps to retain the cable jacket 26 to the backshell 14. The rear well 60 is formed between the top portion 18 and the bottom portion 28 when the two portions are coupled to one another, and FIG. 2 depicts a portion of the jacket positioned in the rear well 60. FIG. 3 more clearly shows that the bottom portion 28 includes a recessed portion 62 that forms part of a lower wall of the rear well 60. The top portion 18 includes another recessed portion 64 that generally opposes the bottom-portion recessed portion 62. The recessed portions 62 and 64 align when the backshell portions 18 and 28 are mated to form the rear well 60.

The electrical connection system might be assembled in various manners, and a process of assembling the connection system will now be described with reference to the various figures. In one embodiment, a step includes prepping a cable assembly by stripping the inner shield 22, the braided outer shield 24, and cable jacket 26 flush down to the set of one or more wires 20. The ferrule 25 is then slid between the inner shield 22 and the braided outer shield 24, and an illustrative depiction of this finished step is provided by FIG. 4. The contacts of the connector 16 might then be prepped (per relevant specs), crimped to the one or more wires 20, and installed into an insulator 70 of the connector 16 by epoxy tacking into place. The ground wire is then terminated and appropriate electrical tests can be run.

Once the cable assembly is coupled to the connector 16, a potting well 66 of the connector 16 is filled approximately two-thirds full with an epoxy. While the epoxy is still wet, the bottom portion 28 of the backshell is inserted into the potting well until the end 68 of the bottom portion 28 contacts a shoulder of the connector shell. The cable jacket 26 is then pulled back beyond the ferrule 25 (i.e., to expose the non-encased portion 24B of the outer shield 24), and the outer shield is adjusted 360 degrees around the ferrule 25.

Figure 5:
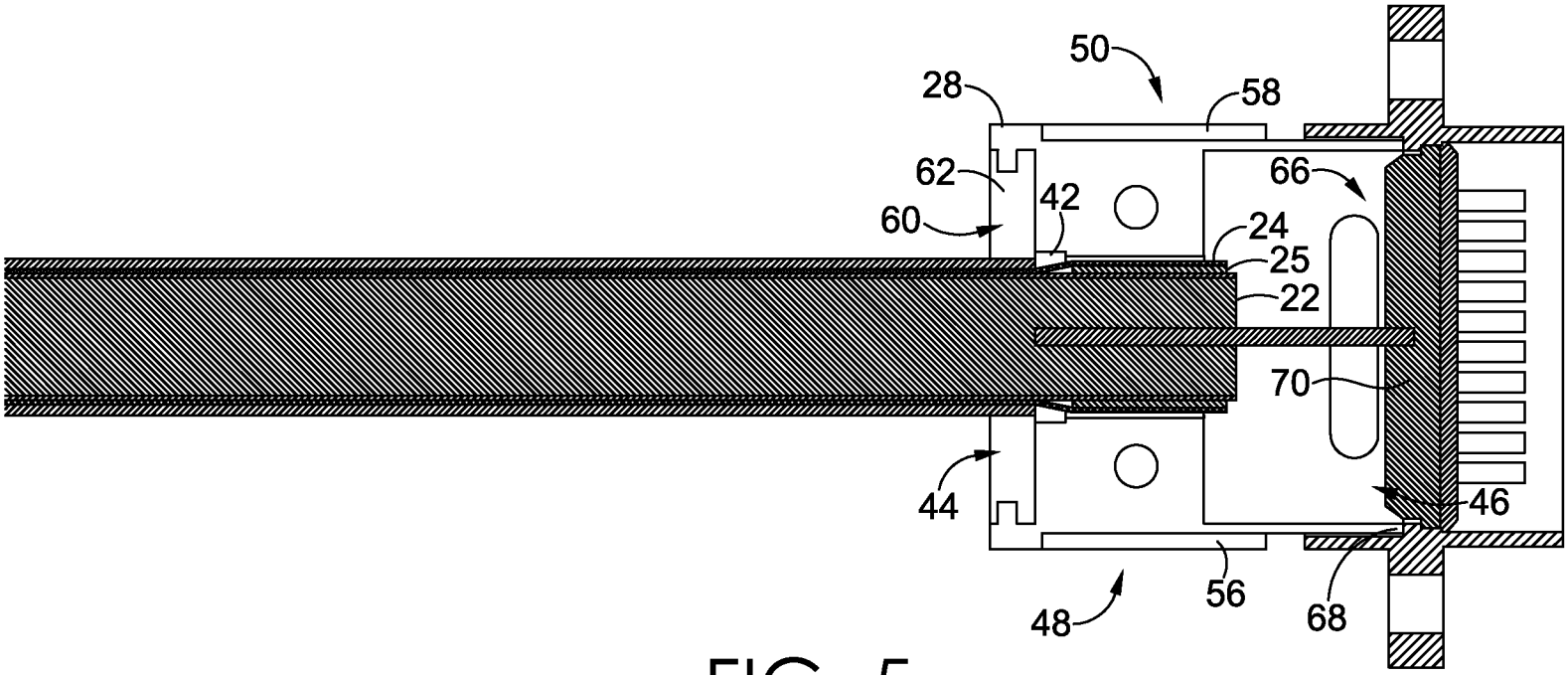
FIG. 5 depicts a cross-sectional view of a cable terminated by a backshell and connector in accordance with an embodiment of the present invention.

Once the braided outer shield 24 is positioned around the ferrule 25 (e.g., FIG. 5), then the top portion 18 of the backshell is installed by securing fasteners through the aligned holes 19A-B and 29A-B. At this point, the braided outer shield 24, the ferrule 25, and the inner shield 22 are clamped in the cylindrical channel and between the top portion 18 and the bottom portion 28, and the non-encased portion 24B of the braided outer shield 24 is positioned in the internal groove 36. The jacket 26 is positioned within the rear well 60, but does not extend into the internal groove 36.

Solder material is then applied to grooves between the backshell 14 and the connector 16 and to the first solder well 52 and the second solder well. In addition, the braided outer shield 24B is soldered to the backshell by applying solder material in the internal groove 36. The cable jacket 26 is then secured inside the backshell by filling the rear well 60 with epoxy 62.

The connection system helps to reduce openings and EMI/RF leaks in the braided outer shield 24 and to improve connection at the entrance. In addition a shield-termination system is provided for a small shielded cable that is terminated into a larger connector shell with a reduced loss in signal integrity from EMI/RF leaks.

Many different arrangements of the various components depicted, as well as components not shown, are possible without departing from the scope of the claims below. Embodiments of our technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

The invention claimed is:

1. An electrical-connection system comprising:

a set of one or more wires;

an inner shield that at least partially encases the set of one or more wires;

a ferrule crimped around a segment of the inner shield, wherein the inner shield includes a non-crimped portion that is not crimped by the ferrule;

a braided shield that at least partially encases the ferrule, wherein the braided shield includes a portion that does not encase the ferrule and that is layered directly adjacent to the non-crimped portion of the inner shield;

a cable jacket that encases the braided shield, wherein the braided shield includes a braided-shield terminus that extends beyond a cable-jacket terminus of the cable jacket, such that the braided shield includes a non-encased portion, which at least partially overlaps with the portion that is layered directly adjacent to the inner shield; and a first backshell member and a second backshell member that mate to form a cylindrical channel for housing the non-encased portion of the braided shield, wherein the first backshell member and the second backshell member include respective:

concave interior surfaces that form walls of the cylindrical channel when the first backshell member is mated with the second backshell member; and concave internal grooves that are adjacent to the respective concave interior surfaces and that circumscribe the portion of the braided shield layered directly adjacent to the inner shield.

2. The system of claim 1, wherein the respective concave internal grooves comprise solder wells for receiving a solder material, which provides a seal around the portion of the braided shield.

3. The system of claim 2, wherein the first second backshell members mate to form a backshell, which includes a cable-insertion end, a terminus end, a first side, and a second side.

4. The system of claim 3, wherein the first and second backshell members include respective first grooves that align to form a first solder well at a first interface between the first and second backshell members along an outward facing surface of the first side; and wherein the first and second backshell members include respective second grooves that align to form a second solder well at a second interface between the first and second backshell members along an outward facing surface of the second side, both the first and second solder wells for receiving a solder material for providing seals.

5. The system of claim 3, wherein the cable insertion end includes an epoxy groove at an interface between the first and second backshell members, and wherein the epoxy groove is adjacent to the solder wells formed by the respective concave internal grooves.

6. The system of claim 1, wherein the respective concave interior surfaces clamp the non-encased portion of the braided shield.

7. A backshell for a cable connector comprising:

a first backshell member having a concave interior surface and a first concave internal groove;

a second backshell member that mates with the first backshell member to form a backshell and that includes a second concave interior surface and a second concave internal groove, wherein the first concave interior surface and the second concave interior surface form a cylindrical channel when the first backshell member and the second backshell member are mated, the cylindrical channel having a cable-insertion end and a cable-terminus end, and wherein the first concave internal groove and the second concave internal groove mate to form a solder well that is positioned adjacent the cable insertion end of the cylindrical channel.

8. The backshell of claim 7, wherein the backshell includes a cable-insertion end for receiving a cable, a terminus end for connecting the cable to a connector, a first side, and a second side.

9. The backshell of claim 8, wherein the first and second backshell members include respective first grooves that align to form a first solder well at a first interface between the first and second backshell members along an outward facing surface of the first side; and wherein the first and second backshell members include respective second grooves that align to form a second solder well at a second interface between the first and second backshell members along an outward facing surface of the second side, both the first and second solder wells for receiving a solder material for providing seals.

10. The backshell of claim 8, wherein the cable-insertion end of the backshell includes an epoxy groove at an interface between the first and second backshell members, and wherein the epoxy groove is adjacent to the solder well formed by the respective concave internal grooves.

11. An electrical-connection system comprising:

a backshell comprising:

a first backshell member having a concave interior surface and a first concave internal groove;

a second backshell member that mates with the first backshell member to form the backshell and that includes a second concave interior surface and a second concave internal groove, wherein the first concave interior surface and the second concave interior surface form a cylindrical channel when the first backshell member and the second backshell member are mated, the cylindrical channel having a cable-insertion end and a cable-terminus end, and wherein the first concave internal groove and the second concave internal groove mate to form a solder well that is positioned adjacent the cable insertion end of the cylindrical channel; and a cable that is inserted into the cable-insertion end of the cylindrical channel, the cable comprising a set of one or more wires;

an inner shield that at least partially encases the set of one or more wires;

a ferrule crimped around a segment of the inner shield, wherein the inner shield includes a non-crimped portion that is not crimped by the ferrule;

a braided shield including a portion that at least partially encases the ferrule and that is encased in the cylindrical channel, wherein the braided shield includes another portion that does not encase the ferrule and that is layered directly adjacent to the non-crimped portion of the inner shield.

12. The system of claim 11, wherein the other portion of the braided shield that does not encase the ferrule is circumscribed by the solder well.

13. The system of claim 11, wherein the backshell includes a top, a bottom, a first side, and a second side.

14. The system of claim 13, wherein the first and second backshell members include respective first grooves that align to form a first solder well at a first interface between the first and second backshell members along an outward facing surface of the first side; and wherein the first and second backshell members include respective second grooves that align to form a second solder well at a second interface between the first and second backshell members along an outward facing surface of the second side, both the first and second solder wells for receiving a solder material for providing seals.

15. The system of claim 11, wherein the cable-insertion end of the backshell includes an epoxy groove at an interface between the first and second backshell members, and wherein the epoxy groove is adjacent to the solder well formed by the respective concave internal grooves.

16. The system of claim 11, wherein the set of one or more wires include a cable diameter and wherein the cylindrical channel of the backshell includes a channel diameter, and wherein a ratio of the cable diameter to the channel diameter is about.

17. The system of claim 11, wherein the set of one or more wires include a cable diameter and the cylindrical channel of the backshell includes a channel diameter, and wherein a ratio of the cable diameter to the channel diameter is about 0.250 to about 0.230.

18. The system of claim 11, wherein the set of one or more wires include a cable diameter and the solder well includes a solder-well diameter, and wherein a ratio of the cable diameter to the solder-well diameter is about 0.250 to about 0.400.

* * * * *